US010007210B2

(12) United States Patent
Okuno et al.

(10) Patent No.: US 10,007,210 B2
(45) Date of Patent: Jun. 26, 2018

(54) DEVELOPING DEVICE INCLUDING A CAPTURING MEMBER AND IMAGE FORMING APPARATUS

(71) Applicant: FUJI XEROX CO., LTD., Tokyo (JP)

(72) Inventors: Taichiro Okuno, Kanagawa (JP); Takuji Matsumoto, Kanagawa (JP); Kaoru Watanabe, Kanagawa (JP); Kazuya Nishimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/437,668

(22) Filed: Feb. 21, 2017

(65) Prior Publication Data

US 2018/0081299 A1 Mar. 22, 2018

(30) Foreign Application Priority Data

Sep. 21, 2016 (JP) ..... 2016-184020

(51) Int. Cl.
*G03G 15/08* (2006.01)
*G03G 15/09* (2006.01)
(Continued)

(52) U.S. Cl.
CPC ..... *G03G 15/0877* (2013.01); *G03G 15/09* (2013.01); *G03G 15/0887* (2013.01);
(Continued)

(58) Field of Classification Search
CPC ..... G03G 15/0877; G03G 15/0887; G03G 15/0898; G03G 15/09; G03G 21/0052;
(Continued)

(56) References Cited

U.S. PATENT DOCUMENTS 8,406,650 B2 3/2013 Kunihiro et al.
2005/0031370 A1* 2/2005 Koshimura ..... G03G 15/0898 399/99

(Continued)

FOREIGN PATENT DOCUMENTS

JP 2007-148335 A 6/2007
JP 4810595 B2 11/2011

*Primary Examiner* — Joseph S Wong
(74) *Attorney, Agent, or Firm* — Sughrue Mion, PLLC

(57) ABSTRACT

A developing device includes a developer accommodating container, a developer carrier, an exhaust path, a capturing member, and a closing member. The developer accommodating container accommodates a developer. The developer carrier is disposed in an opening of the developer accommodating container to be rotated while facing an image carrier, and carries the developer. The exhaust path exhausts an air in the developer accommodating container to an outside. The capturing member captures a toner in the exhausted air passing through the exhaust path. The closing member includes a base end portion and a tip end portion. The base end portion is held by the developer accommodating container. The tip end portion is sandwiched between the developer accommodating container and the developer carried on the developer carrier, downstream of the opening in a rotation direction of the developer carrier. The closing member closes a gap.

11 Claims, 12 Drawing Sheets

(51) Int. Cl.
*G03G 21/00* (2006.01)
*G03G 21/10* (2006.01)
*G03G 21/20* (2006.01)

(52) U.S. Cl.
CPC ..... *G03G 15/0898* (2013.01); *G03G 21/0052* (2013.01); *G03G 21/10* (2013.01); *G03G 21/105* (2013.01); *G03G 21/20* (2013.01); *G03G 21/206* (2013.01)

(58) Field of Classification Search
CPC ..... G03G 21/10; G03G 21/105; G03G 21/20; G03G 21/206; G03G 2221/0094
See application file for complete search history.

(56) References Cited

U.S. PATENT DOCUMENTS

2005/0095028 A1* 5/2005 Lee ..... G03G 15/0898 399/98
2006/0078348 A1* 4/2006 Watanabe ..... G03G 21/0052 399/99
2010/0296834 A1* 11/2010 Omori ..... G03G 15/0898 399/99
2014/0270838 A1* 9/2014 Yoshizawa ..... G03G 15/0893 399/99
2017/0212448 A1* 7/2017 Fujimori ..... G03G 15/081

* cited by examiner

DEVELOPING DEVICE INCLUDING A CAPTURING MEMBER AND IMAGE FORMING APPARATUS

CROSS-REFERENCE TO RELATED APPLICATIONS

This application is based on and claims priority under 35 USC 119 from Japanese Patent Application No. 2016-184020 filed Sep. 21, 2016.

BACKGROUND

Technical Field

The present invention relates to a developing device and an image forming apparatus.

SUMMARY

According to an aspect of the invention, a developing device includes a developer accommodating container, a developer carrier, an exhaust path, a capturing member, and a closing member. The developer accommodating container is configured to accommodate a developer. The developer carrier is disposed in an opening of the developer accommodating container to be rotated while facing an image carrier, and is configured to carry the developer. The exhaust path is configured to exhaust an air in the developer accommodating container to an outside. The capturing member is configured to capture a toner in the exhausted air passing through the exhaust path. The closing member includes a base end portion and a tip end portion. The base end portion is held by the developer accommodating container. The tip end portion is sandwiched between the developer accommodating container and the developer carried on the developer carrier, downstream of the opening in a rotation direction of the developer carrier. The closing member is configured to close a gap.

BRIEF DESCRIPTION OF THE DRAWINGS

Exemplary embodiments of the present invention will be described in detail based on the following figures, wherein.

DETAILED DESCRIPTION

Hereinafter, exemplary embodiments for carrying out the present invention (hereinafter, referred to as an "exemplary embodiment") will be described with reference to the drawings.

First Exemplary Embodiment

Figure 1:
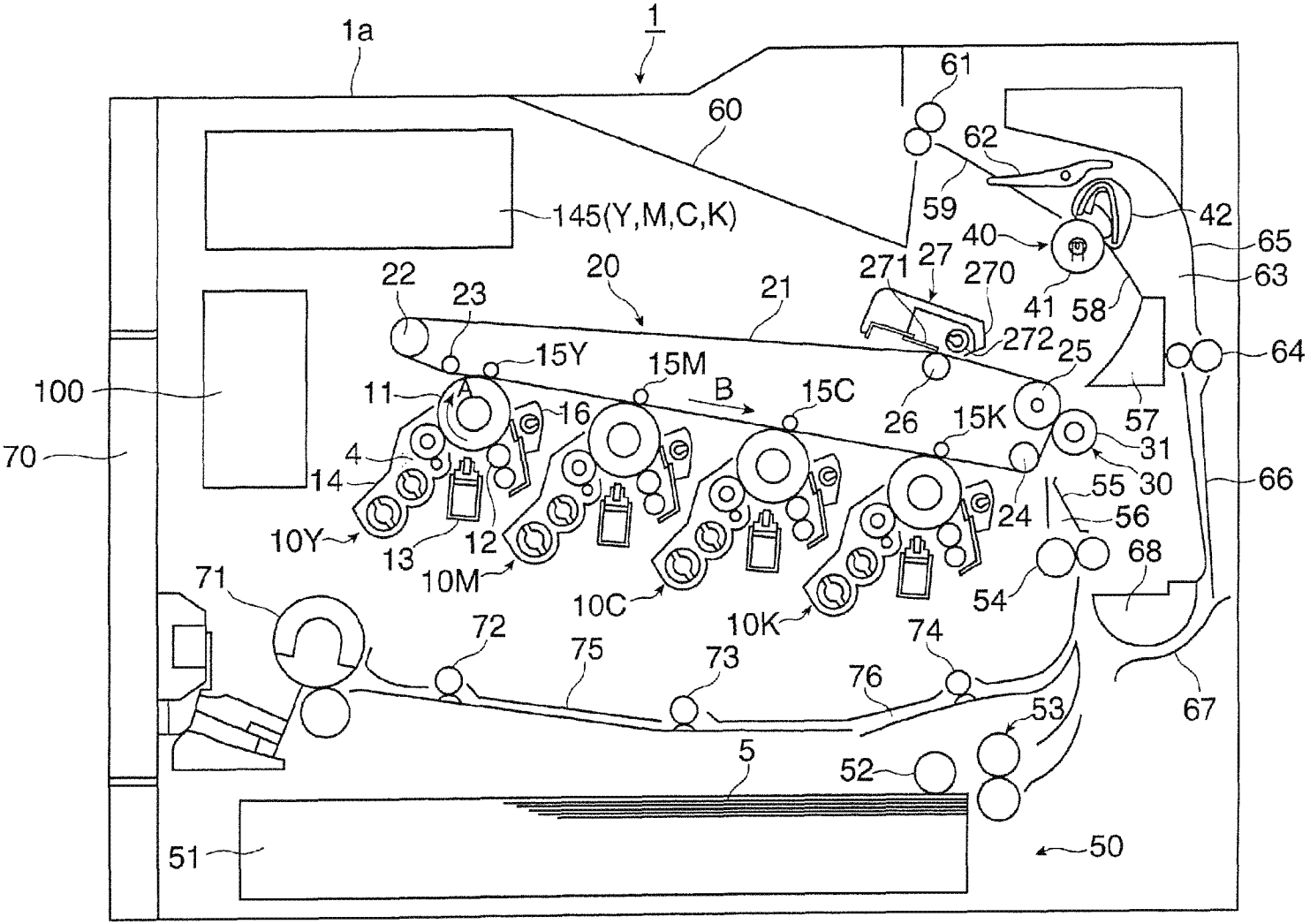
FIG. 1 is a schematic configuration view illustrating an image forming apparatus according to a first exemplary embodiment of the present invention.
Figure 2:
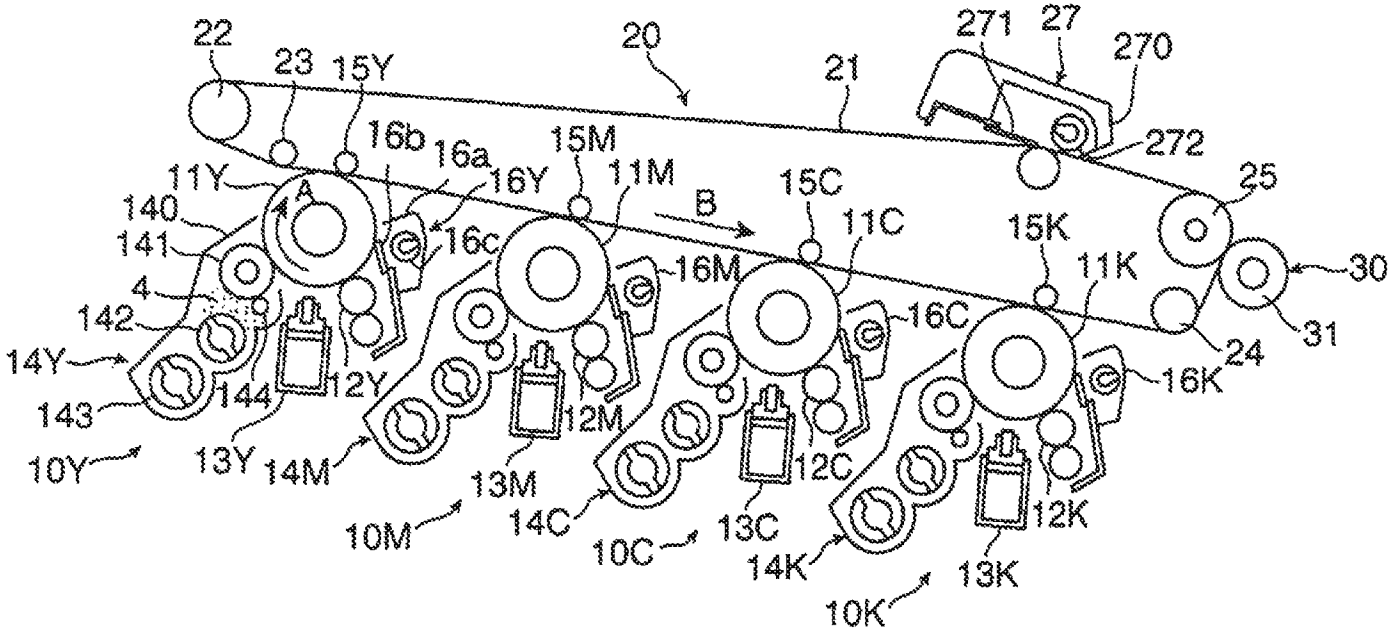
FIG. 2 is a configuration view illustrating an image forming unit of the image forming apparatus according to the first exemplary embodiment of the present invention.

FIGS. 1 and 2 are views illustrating an image forming apparatus to which a developing device according to the first, exemplary embodiment is applied. FIG. 1 illustrates an outline of the entire image forming apparatus, and FIG. 2 illustrates a main part (an image forming device and the like) of the image forming apparatus in an enlarged scale.

<Entire Configuration of Image Forming Apparatus>

For example, an image forming apparatus 1 according to the first exemplary embodiment is configured as a color printer. The image forming apparatus 1 includes plural image forming devices 10, an intermediate transfer device 20, a sheet feeding device 50, and a fixing device 40. The image forming devices 10 form toner images to be developed with a toner that constitutes a developer 4. The intermediate transfer device 20 carries the toner images formed by the respective image forming devices 10 and transports the toner images to a secondary transfer position where the toner images are finally and secondarily transferred to a recording sheet 5. The recording sheet 5 is an example of a recording medium. The sheet feeding device 50 accommodates and transports predetermined recording sheets 5 to be supplied to the secondary transfer position of the intermediate transfer device 20. The fixing device 40 fixes the toner image secondarily which are transferred to the recording sheet 5 in the intermediate transfer device 20. In addition, la in the drawing indicates a main body of the image forming apparatus 1, and the main body 1*a* is formed with a support structure member, an external cover, and the like.

The image forming devices 10 includes four image forming devices 10Y, 10M, 10C, and 10K that exclusively form four colored toner images of yellow Y, magenta M, cyan C, and black K, respectively. The four image forming devices 10Y, 10M, 10C, and 10K are disposed in a row in a state of being inclined in an internal space of the main body 1*a*. Among the four image forming devices 10Y, 10M, 10C, and 10K, the image forming device 10Y of yellow Y is positioned at a relatively high position in the vertical direction, and the image forming device 10K of black K is positioned at a relatively low position in the vertical direction.

As illustrated in FIG. 1 or 2, each of the image forming devices 10Y, 10M, 10C, and 10K of yellow Y, magenta M, cyan C, and black K is provided with a rotating photoconductor drum 11 which is an example of an image carrier. The rotating photoconductor drum 11 carries an electrostatic latent image. The following devices which are examples of the toner image forming units are mainly disposed around the photoconductor drum 11. The main devices include a charging device 12, an exposure device 13, a developing device 14Y, 14M, 14C, or 14K, a primary transfer device 15Y, 15M, 15C, or 15K, and a drum cleaning device 16Y, 16M, 16C, or 16K. The charging device 12 charges a circumferential surface (an image carrying surface) of the photoconductor drum 11 on which an image may be formed, with a predetermined electric potential. The exposure device 13 is an example of an electrostatic latent image forming unit. The exposure device 13 forms an electrostatic latent image (for each color) having a potential difference by irradiating the charged circumferential surface of the photoconductor drum 11 with light based on information (a signal) of an image. The developing device 14Y, 14M, 14C, or 14K forms a toner image by developing the electrostatic latent image with the toner of the developer 4 having a corresponding color Y, M, C, or K. The primary transfer device 15Y, 15M, 15C, or 15K is an example of a primary transfer unit. The primary transfer device 15Y, 15M, 15C, or 15K transfers the toner image to the intermediate transfer device 20. The drum cleaning device 16Y, 16M, 16C, or 16K cleans the image carrying surface of the photoconductor drum 11 by removing attached substances such as toner remaining and attached to the image carrying surface of the photoconductor drum 11 after the primary transfer.

The photoconductor drum 11 has an image carrying surface formed on a circumferential surface of a base member having a cylindrical shape or a columnar shape. The base member is grounded. The image carrying surface has a photoconductive layer (photosensitive layer) made of a photosensitive material. The photoconductor drum 11 is supported to be rotated in a direction indicated by an arrow A by a power transmitted from a rotation driving device (not illustrated).

The charging device 12 includes a contact charging roller disposed in a state of being in contact with the photoconductor drum 11. A charging voltage is supplied to the charging device 12. In a case in which the developing device 14 performs a reverse development, a voltage or a current, which has a polarity identical to the charge polarity of the toner supplied from the developing device 14, is supplied as the charging voltage. In addition, as the charging device 12, a non-contact charging device such as a scorotron disposed in a non-contact state in relation to the surface of the photoconductor drum 11 may be used.

The exposure device 13 is configured to form an electrostatic latent image by irradiating the circumferential surface of the photoconductor drum 11 after being charged, with light which is configured according information of an image input to the image forming apparatus 1. When a latent image is about to be formed, the information (a signal) of the image input to the image forming apparatus 1 by an arbitrary unit is transmitted to the exposure device 13.

The exposure device 13 includes an LED print head that forms an electrostatic latent image by irradiating the photoconductor drum 11 with light according to the image information using LEDs (light emitting diodes) as plural light emitting elements arranged along the axial direction of the photoconductor drum 11. In addition, an exposure device, which deflects and scans laser light configured based on the image information along the axial direction of the photoconductor drum 11, may be used as the exposure device 13.

As illustrated in FIG. 2, each of the developing devices 14Y, 14M, 14C, and 14K includes a developing roller 141, agitation transport members 142 and 143, and a layer thickness regulating member 144 in a device housing 140. The device housing 140 is an example of a developer accommodating container. The device housing 140 is formed with an opening and an accommodation chamber for the developer 4. The developing roller 141 carries the developer 4 and transports the developer 4 to a developing region that faces the photoconductor drum 11. The agitation transport members 142 and 143 are, for example, two screw augers. The agitation transport members 142 and 143 transport the developer 4 through the developing roller 141 while agitating the developer 4. The layer thickness regulating member 144 regulates the amount (a layer thickness) of developer carried on the developing roller 141. The developing device 14 receives a developing voltage that is supplied between the developing roller 141 and the photoconductor drum 11 from a power source (not illustrated). In addition, the developing roller 141 and the agitation transport members 142 and 143 are rotated in a predetermined direction by the power transmitted from the rotation driving device (not illustrated). In addition, a two-component developer including a non-magnetic toner and a magnetic carrier is used as the four colored developers 4Y, 4M, 4C, and 4K. In addition, the configurations of the developing devices 14Y, 14M, 14C, and 14K will be described in detail below.

Each of the primary transfer devices 15Y, 15M, 15C, and 15K is a contact transfer device having a primary transfer roller which rotates while being in contact with the circumference of the photoconductor drum 11 through an intermediate transfer belt 21 and is supplied with a primary transfer voltage. As the primary transfer voltage, a direct current voltage having a polarity opposite to the charge polarity of the toner is supplied from the power source (not illustrated).

As illustrated in FIG. 2, each drum cleaning device 16 includes a main body 16*a*, a cleaning plate 16*b*, and a delivery member 16*c*. The main body 16*a* has a container shape a part of which is opened. The cleaning plate 16*b* is disposed to be in contact with the circumferential surface of the photoconductor drum 11 after the primary transfer with a predetermined pressure. The cleaning plate 16*b* cleans the circumferential surface of the photoconductor drum 11 by removing attached substances such as a residual toner. The delivery member 16*c* is, for example, a screw auger. The delivery member 16*c* collects and transports the attached substances such as toner removed by the cleaning plate 16*b* such that the attached substances are delivered to a collection system (not illustrated). A plate shaped member (e.g., a blade) made of a material such as rubber is used as the cleaning plate 16*b*.

As illustrated in FIG. 1, the intermediate transfer device 20 is disposed above the respective image forming devices 10Y, 10M, 10C, and 10K. The intermediate transfer device 20 mainly includes the intermediate transfer belt 21, plural belt support rollers 22 to 26, a secondary transfer device 30, and a belt cleaning device 27. The intermediate transfer belt 21 rotates in a direction indicated by an arrow B while passing through a primary transfer position between the photoconductor drum 11 and the primary transfer devices 15 (primary transfer rollers). The belt support rollers 22 to 26 are disposed inside the intermediate transfer belt 21 and maintain the intermediate transfer belt 21 to be in a desired state. The belt support rollers 22 to 26 rotatably support the intermediate transfer belt 21. The secondary transfer device 30 is an example of a secondary transfer member. The secondary transfer device 30 is disposed at a side of an outer circumferential surface (image carrying surface), supported by the belt support roller 25, of the intermediate transfer belt 21. The secondary transfer device 30 secondarily transfers the toner image on the intermediate transfer belt 21 to the recording sheet 5. The belt cleaning device 27 cleans the outer circumferential surface of the intermediate transfer belt 21 by removing attached substances such as remaining attached toner and paper dust after the intermediate transfer belt 21 passes through the secondary transfer device 30.

As the intermediate transfer belt 21, an endless belt is used which is manufactured using a material formed by dispersing a resistance adjusting agent such as carbon black to synthetic resin (e.g., polyimide resin or polyamide resin). In addition, the belt support roller 22 is configured as a driving roller rotated by a driving device (not illustrated). The belt support roller 23 is configured as a facing roller that maintains a traveling position of the intermediate transfer belt 21. The belt support roller 24 is configured as a tension providing roller that provides a tension to the intermediate transfer belt 21. The belt support roller 25 is configured as a backup roller for secondary transfer. The belt support roller 26 is configured as a support roller that supports the intermediate transfer belt 21, with which the belt cleaning device 27 is in contact, from a rear side of the intermediate transfer belt 21.

As illustrated in FIG. 1, the secondary transfer device 30 is a contact transfer device, which has a secondary transfer roller 31 that rotates while being in contact with the circumferential surface of the intermediate transfer belt 21 and is supplied with a secondary transfer voltage, at a secondary transfer position which is a portion of the outer circumferential surface of the intermediate transfer belt 21 of the intermediate transfer device 20 supported by the belt support roller 25. In addition, as the secondary transfer voltage, a direct current voltage exhibiting a polarity opposite or identical to the charge polarity of the toner is supplied to the secondary transfer roller 31 or the support roller 25 of the intermediate transfer device 20.

The belt cleaning device 27 includes a main body 270, a cleaning plate 271, and a delivery member 272. The main body 270 has a container shape a part of which is opened. The cleaning plate 271 is disposed to be in contact with the circumferential surface of the intermediate transfer belt 21 after the secondary transfer with a necessary pressure. The cleaning plate 271 cleans the circumferential surface of the intermediate transfer belt 21 by removing attached substances such as residual toner. The delivery member 272 is, for example, a screw auger. The delivery member 272 collects and transports the attached substances such as toner removed by the cleaning plate 271 such that the attached substances are delivered to a collection system (not illustrated). A plate shaped member (e.g., a blade) made of a material such as rubber is used as the cleaning plate 271.

The fixing device 40 includes a heated rotating body 41 and a pressurizing rotating body 42. The heated rotating body 41 is of a drum type or a belt type. The heated rotating body is heated by a heating unit so that a surface temperature is maintained to a necessary temperature. The pressurizing rotating body 42 is of a drum type or a belt type. The pressurizing rotating body 42 rotates while being in contact with the heated rotating body 41 with predetermined pressure substantially along the axial direction of the heated rotating body 41. In the fixing device 40, a contact portion where the heated rotating body 41 and the pressurizing rotating body 42 are in contact with each other is a fixing processing unit that performs a necessary fixing process (heating and pressing processes).

The sheet feeding device 50 is disposed below the image forming devices 10Y, 10M, 10C, and 10K of yellow Y, magenta M, cyan C, and black K. The sheet feeding device 50 mainly includes a single (or plural) sheet accommodating body 51 and delivery devices 52 and 53. The sheet accommodating body 51 accommodates recording sheets 5 having a desired size and type in a state in which the recording sheets 5 are stacked. The delivery devices 52 and 53 deliver the recording sheets 5 one by one from the sheet accommodating body 51. For example, the sheet accommodating body 51 is mounted so that the sheet accommodating body 51 can be withdrawn to a front side of the main body 1*a* (a side facing a user when the user manipulates the main body 1*a*. In FIG. 1, the sheet accommodating body 51 can be withdrawn to the left side.

The recording sheets 5 may be, for example, plain papers, thin papers, and OHP sheets that are used for electrophotographic copiers, printers, and the like. In order to more improve smoothness of an image surface after fixing an image, the front surfaces of the recording sheets 5 may also be smooth if possible, and for example, so-called a thick paper having a relatively larger basis weight such as coated paper formed by coating a surface of a plain paper with a resin or the like and an art paper for printing may be used.

Between the sheet feeding device 50 and the secondary transfer device 30, a sheet feeding transport path 56 is formed by a single (or plural) sheet transport roller pair (s) 54 and a transport guide 55 to transport a recording sheet 5 delivered from the sheet feeding device 50 to the secondary transfer position. For example, the sheet transport roller pair 54 is configured as a roller (registration roller) that adjusts the transport timing of the recording sheet 5. In addition, between the secondary transfer device 30 and the fixing device 40, transport guides 57 and 58 are provided to transport the recording sheet 5 after the secondary transfer, which is delivered from the secondary transfer roller 31 of the secondary transfer device 30 to the fixing device 40. In addition, at a portion close to a discharge port of a sheet which is formed in the main body 1*a*, a sheet discharge roller pair 61 is disposed to discharge the recording sheet 5 after the fixing, which is delivered from the fixing device 40 to a sheet discharge unit 60 provided above the main body 1*a* through a transport guide 59.

Between the fixing device 40 and the sheet discharge roller pair 61, a switching gate 62 is provided to switch sheet transport paths. A rotation direction of the sheet discharge roller pair 61 may be switched between a forward rotation direction (discharge direction) and a reverse rotation direction. In a case in which images are formed on both sides of the recording sheet 5, a trailing end of the recording sheet 5 one side of which is formed with an image passes through the switching gate 62, and then the rotation direction of the sheet discharge roller pair 61 is switched from the forward rotation direction (discharge direction) to the reverse rotation direction. The transport path is switched by the switching gate 62, and the recording sheet 5 transported in the reverse rotation direction by the sheet discharge roller pair 61 is transported to a duplex transport path 63 which is formed in a substantially vertical direction. The duplex transport path 63 is provided with a sheet transport roller pair 64 that transports the recording sheet 5 to the sheet transport roller pair 54 in a state in which the front and back surfaces of the recording sheet 5 are reversed, transport guides 65 to 68, and the like.

In FIG. 1, reference numeral 70 indicates a manual feed tray installed to be openable/closable on the front side (the left side in the drawing) of the main body 1*a* of the image forming apparatus 1. Between the manual feed tray 70 and the sheet transport roller pair 54, a manual sheet feeding transport path 76 is formed which is configured with a delivery device 71 that delivers the recording sheets 5 accommodated in the manual feed tray 70 one by one, plural pairs of sheet transport rollers 72 to 74, a transport guide 75, and the like.

In FIG. 1, reference numerals 145Y, 145M, 145C, and 145K indicate plural toner cartridges, respectively, which are arranged in a direction perpendicular to the sheet of the drawing and each of which accommodates a developer including at least a toner to be supplied to the corresponding one of the developing device 14Y, 14M, 14C, and 14K.

In addition, reference numeral 100 in FIG. 1 indicates a controller which collectively controls the operations of the image forming apparatus 1. The controller 100 is provided with a central processing unit (CPU) (not illustrated), a read only memory (ROM), or a random access memory (RAM), a bus that interconnects the CPU, the ROM, and the like, a communication interface, or the like.

<Operation of Image Forming Apparatus>

Hereinafter, basic image forming operations performed by the image forming apparatus 1 will be described.

Here, an operation of forming a full-color image configured by combining four-color (Y, M, C, and K) toner images by using the four image forming devices 10Y, 10M, 10C, and 10K will be described.

When the image forming apparatus 1 receives command information requesting an image forming operation (print), the four image forming devices 10Y, 10M, 10C, and 10K, the intermediate transfer device 20, the secondary transfer device 30, and the fixing device 40 are started.

In each of the image forming devices 10Y, 10M, 10C, and 10K, the photoconductor drum 11 rotates in the direction indicated by the arrow A first, and the charging device 12 charges the surface of the photoconductor drum 11 with necessary polarity (in the first exemplary embodiment, negative polarity) and electric potential. Subsequently, the exposure device 13 irradiates the surface of the photoconductor drum 11 after the charging with light, which is emitted based on a signal of an image obtained by converting image information input to the image forming apparatus 1 into respective color components Y, M, C, and K, thereby forming an electrostatic latent image of each color component configured by a predetermined potential difference on the surface thereof.

Subsequently, the respective image forming devices 10Y, 10M, 10C, and 10K perform development by supplying the toners, each of which has a corresponding one of colors Y, M, C, and K and is charged with a predetermined polarity (negative polarity), from the developing rollers 141 to the electrostatic latent images, each of which has a corresponding one of the color components and is formed on a corresponding one of the photoconductor drums 11, so that the toners are electrostatically attached to the electrostatic latent images, respectively. With this development, the electrostatic latent images, each of which has a corresponding one of the four color components and is formed on a corresponding one of the photoconductor drums 11, are developed as toner images, each of which is developed by a toner having a corresponding one of the four colors Y, M, C, and K.

Subsequently, when the toner images with the respective colors formed on the photoconductor drums 11 of the respective image forming devices 10Y, 10M, 10C, and 10K are transported to the primary transfer positions of the respective colors, the primary transfer devices 15Y, 15M, 15C, and 15K primarily transfer the toner images of the respective colors to the intermediate transfer belt 21 of the intermediate transfer device 20, which rotates in the direction indicated by the arrow B, so that the toner images with the respective colors are sequentially superposed one on another.

In addition, in each image forming device 10 on which the primary transfer is terminated, the drum cleaning device 16 cleans the surface of the photoconductor drum 11 by scraping and removing attached substances. Therefore, each image forming device 10 is in a state of being capable of performing the next image forming operation.

Subsequently, the intermediate transfer device 20 carries a toner image primarily transferred by the rotation of the intermediate transfer belt 21, and transports the toner image to the secondary transfer position. Meanwhile, the sheet feeding device 50 delivers a predetermined recording sheet 5 to the sheet feeding transport path 56 in accordance with the image forming operation. In the sheet feeding transport path 56, the sheet transport roller pair 54, which serves as registration rollers, delivers and supplies the recording sheet 5 to the secondary transfer position in accordance with the transfer timing.

At the secondary transfer position, the secondary transfer roller 31 of the secondary transfer device 30 secondarily transfers all the toner images on the intermediate transfer belt 21 to the recording sheet 5 in a lump. In addition, in the intermediate transfer device 20 in which the secondary transfer has been terminated, the belt cleaning device 27 cleans the surface of the intermediate transfer belt 21 after the secondary transfer by removing attached substances such as the toners remaining on the surface of the intermediate transfer belt 21.

Subsequently, the recording sheet 5, to which the toner image is secondarily transferred, is separated from the intermediate transfer belt 21 and the secondary transfer roller 31, and then transported to the fixing device 40 through the transport guides 57 and 58. In the fixing device 40, the recording sheet 5 after the secondary transfer is introduced into and passes through the contact portion between the heated rotating body 41 and the pressurizing rotating body 42, and the recording sheet 5 is subjected to predetermined fixing processes (heating and pressing) so that a unfixed toner image is fixed to the recording sheet 5. Finally, in the case of the image forming operation of forming an image on a single side of the recording sheet 5, the recording sheet 5 on which the fixing has been terminated is discharged by the sheet discharge roller pair 61 to, for example, the sheet discharge unit 60 provided in the upper portion of the main body 1*a*.

In a case in which images are formed on both sides of the recording sheet 5, the rotation direction of the sheet discharge roller pair 61 is switched to the reverse rotation direction while the sheet discharge roller pair 61 maintains a trailing end of the recording sheet 5, rather than entirely discharging the recording sheet 5 having an image formed on one side thereof to the sheet discharge unit 60 by the sheet discharge roller pair 61. The recording sheet 5, which is transported in the reverse direction by the sheet discharge roller pair 61, passes through an upper side of the switching gate 62, and then is transported to the sheet transport roller pair 54 in a state in which the front and back surfaces of the recording sheet 5 are reversed through the duplex transport path 63 that is provided with the sheet transport roller pair 64, the transport guides 65 to 68, and the like. The sheet transport roller pair 54 delivers and supplies the recording sheet 5 to the secondary transfer position in accordance with the transfer timing so that an image is formed on the back surface of the recording sheet 5. Then, the recording sheet 5 is discharged by the sheet discharge roller pair 61 to the sheet discharge unit 60 provided in the upper portion of the main body 1*a*.

According to the forgoing operations, the recording sheet 5 formed with a full-color image formed by combining toner images of four colors is output.

<Configuration of Process Cartridge>

In this exemplary embodiment, a photoconductor drum 11 and an image forming member including a charging device 12, a developing device 14, and a drum cleaning device 16 which are disposed around the photoconductor drum 11 are integrated to form a single unit and assembled, thereby constituting a process cartridge 80 which is an example of an image forming unit. In addition, the exposure device 13 is unitized alone separately from the process cartridge 80.

Figure 3:
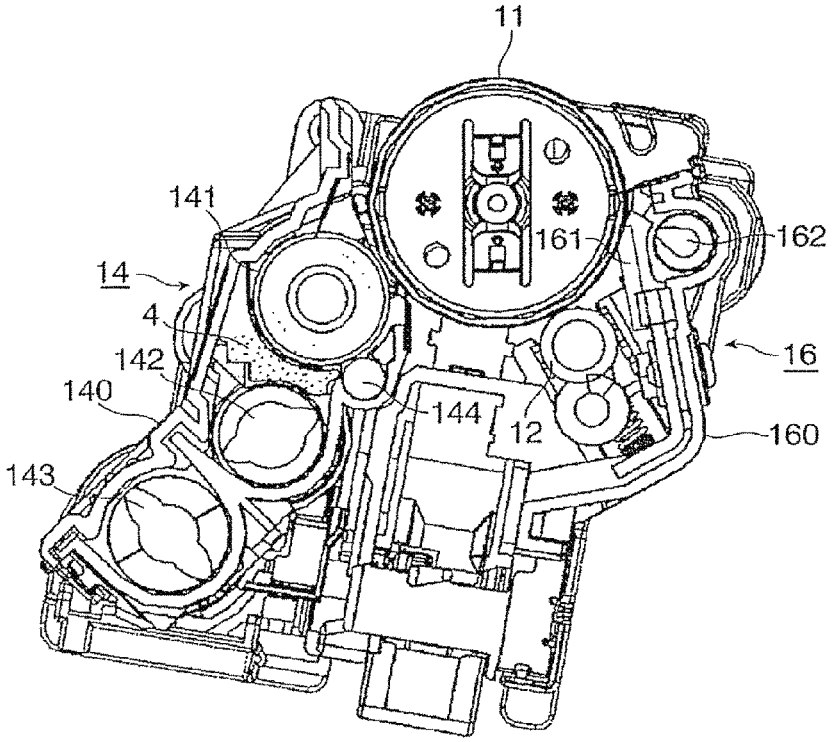
FIG. 3 is a cross-sectional configuration view illustrating a process cartridge.
Figure 4:
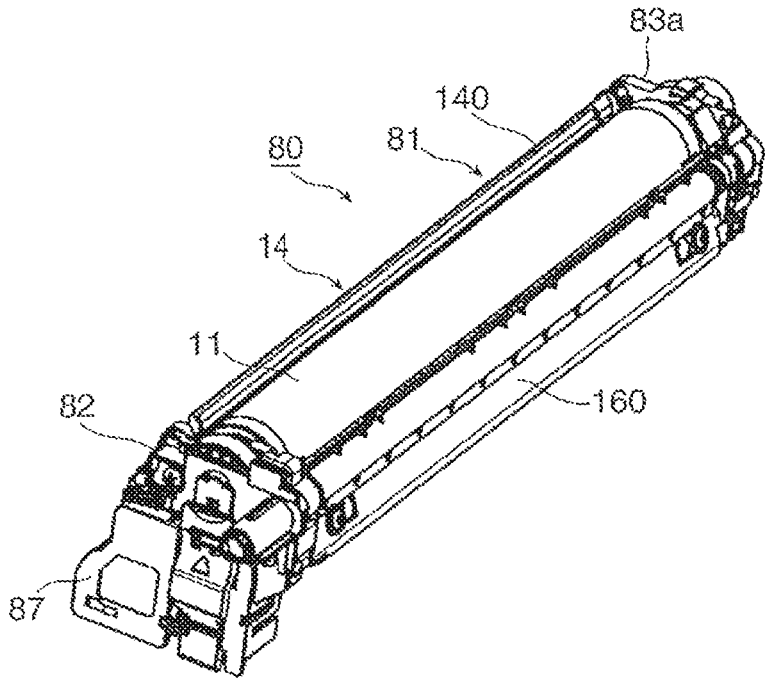
FIG. 4 is a perspective configuration view illustrating the process cartridge.
Figure 5:
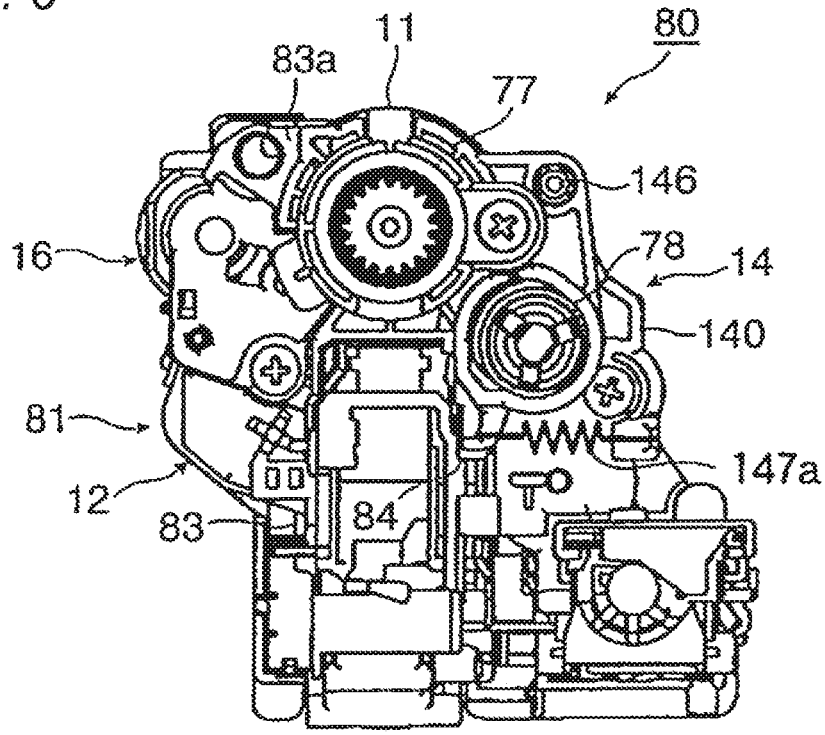
FIG. 5 is a rear configuration view illustrating the process cartridge.
Figure 6:
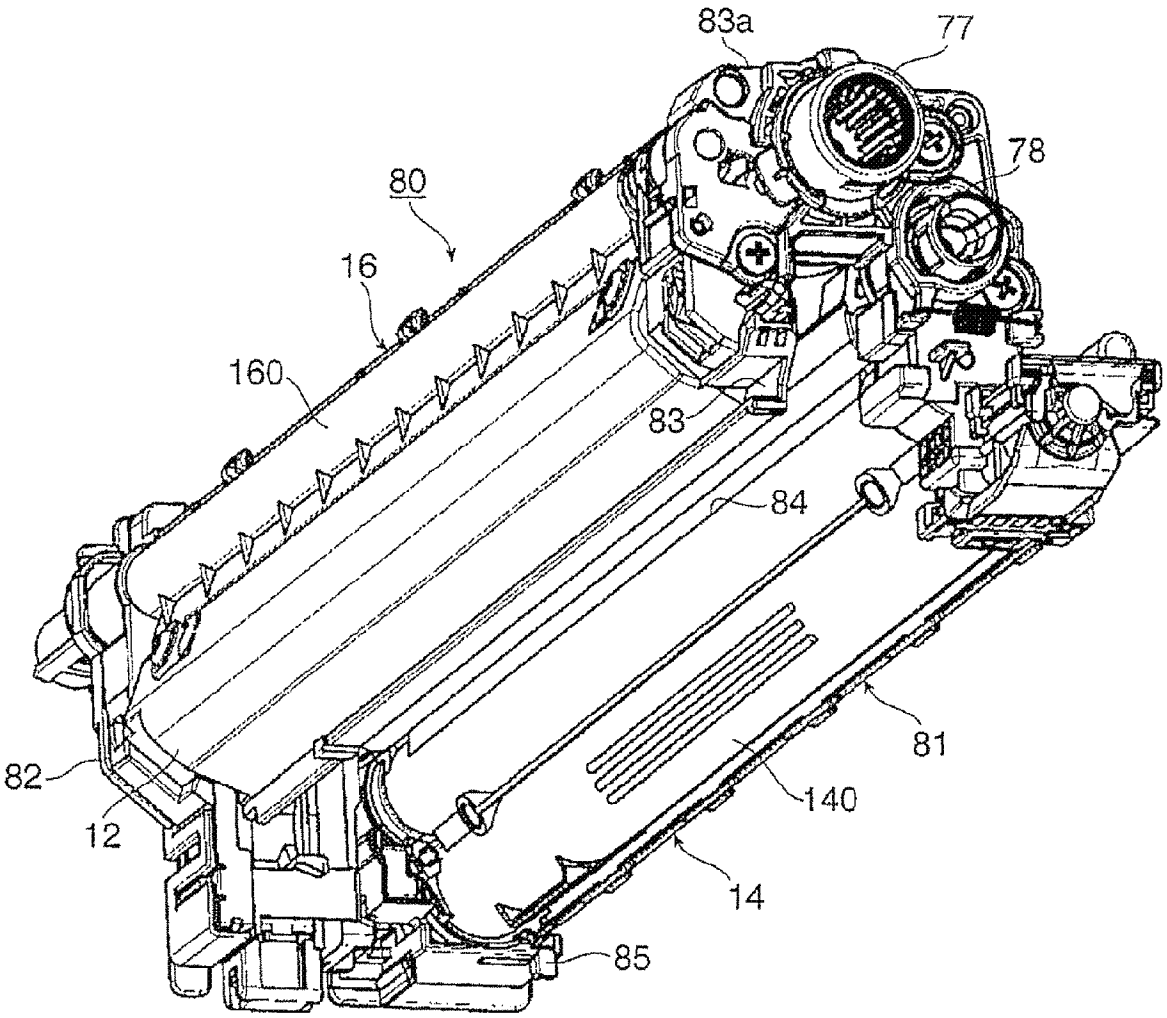
FIG. 6 is a perspective view illustrating an external appearance of the process cartridge.

FIG. 3 is a cross-sectional configuration view illustrating the process cartridge 80. FIG. 4 is a perspective view illustrating an external appearance of the process cartridge 80 when viewed from an obliquely upper side at the front side in a direction in which the process cartridge 80 is mounted. FIG. 5 is a side view illustrating the process cartridge 80 when viewed from a leading end side (the inner side) in the direction in which the process cartridge 80 is mounted. FIG. 6 is a perspective view illustrating an external appearance of the process cartridge 80 when viewed from a obliquely lower side at the inner side in the direction in which the process cartridge 80 is mounted.

As illustrated in FIGS. 3 to 6, the process cartridge 80 is provided with a process cartridge main body 81. The process cartridge main body 81 is an example of an image forming unit main body. In the process cartridge 80, the photoconductor drum 11, the charging device 12, the developing device 14, and the drum cleaning device 16 are integrated into a single unit and mounted. In the illustrated exemplary embodiment, the process cartridge main body 81 includes the device housing 140 of the developing device 14, the main body 16*a* of the drum cleaning device 16, and frame members 82 and 83 which are disposed at front and inner end portions, respectively, in the direction in which the process cartridge 80 is mounted.

The photoconductor drum 11 is rotatably mounted on the frame members 82 and 83 of the process cartridge main body 81. Meanwhile, as illustrated in FIG. 5, the developing roller 141 of the developing device 14 is mounted to be capable of swinging about a swing fulcrum 146 with respect to the process cartridge main body 81 in a direction in which the developing roller 141 is brought into contact with or separated from the photoconductor drum 11. In addition, the developing device 14 is configured as follows. That is, the photoconductor drum 11 is rotatably mounted on the process cartridge main body 81. Elastic members 147*a* such as coil springs are disposed over between the device housing 140 of the developing device 14 and the frame members 82 and 83 of the process cartridge main body 81. Tracking rollers (not illustrated) as gap setting members are disposed at both end portions of the developing roller 141 in the axial direction. The elastic members 147*a* makes the tracking rollers abut against the surface of the photoconductor drum 11. With this configuration, a gap (a so-called DRS) between the photoconductor drum 11 and the developing roller 141 is precisely set to a predetermined value. As illustrated in FIGS. 5 and 6, a first driving force transmission unit 77 which transmits a driving force to the photoconductor drum 11, and a second driving force transmission unit 78 which transmits a driving force to the developing roller 141 are provided to protrude on an end surface at the leading end side in the direction in which the process cartridge 80 is mounted.

Figure 7:
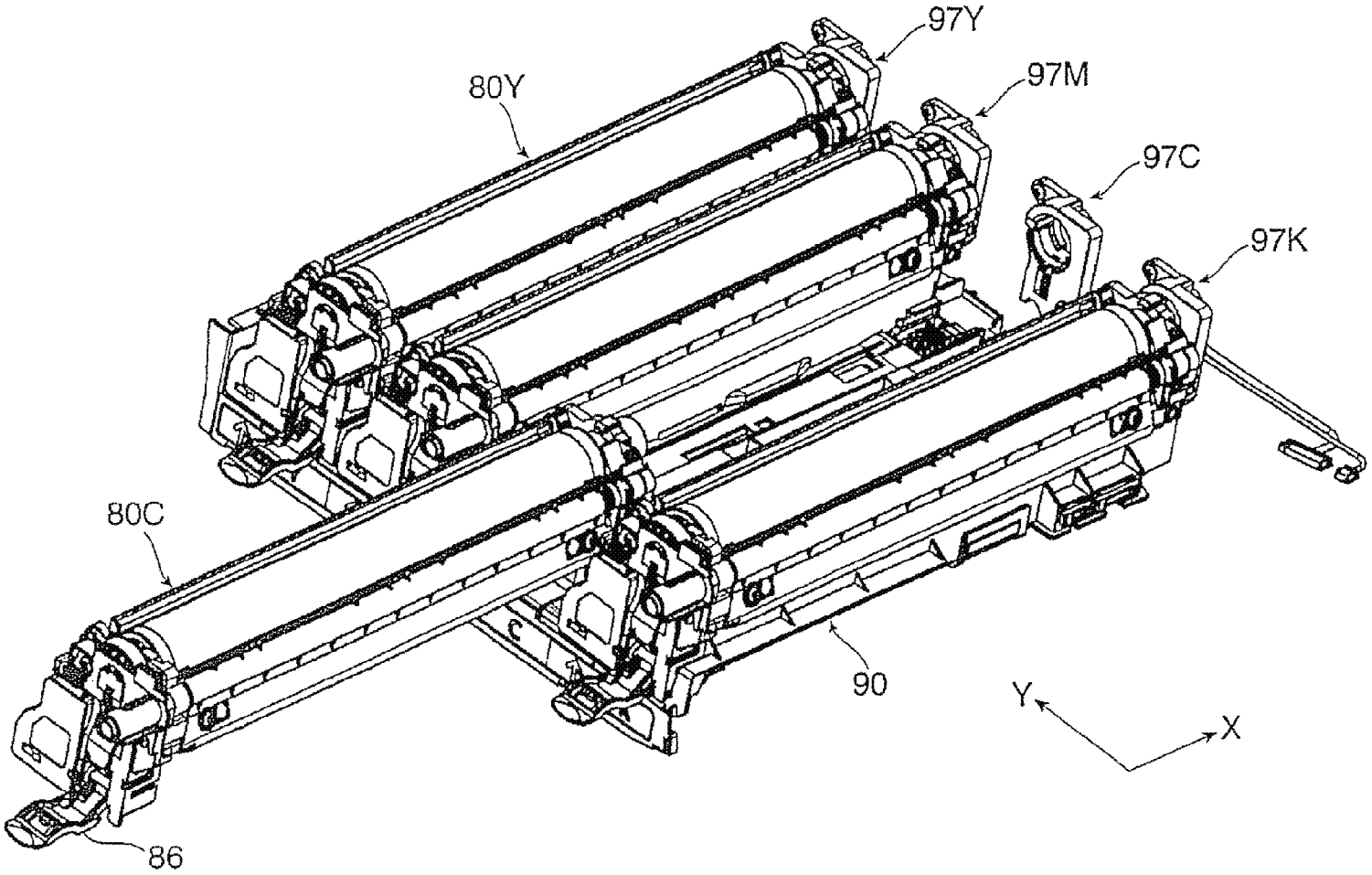
FIG. 7 is a perspective configuration view illustrating a state in which the process cartridge is mounted.
Figure 8A:
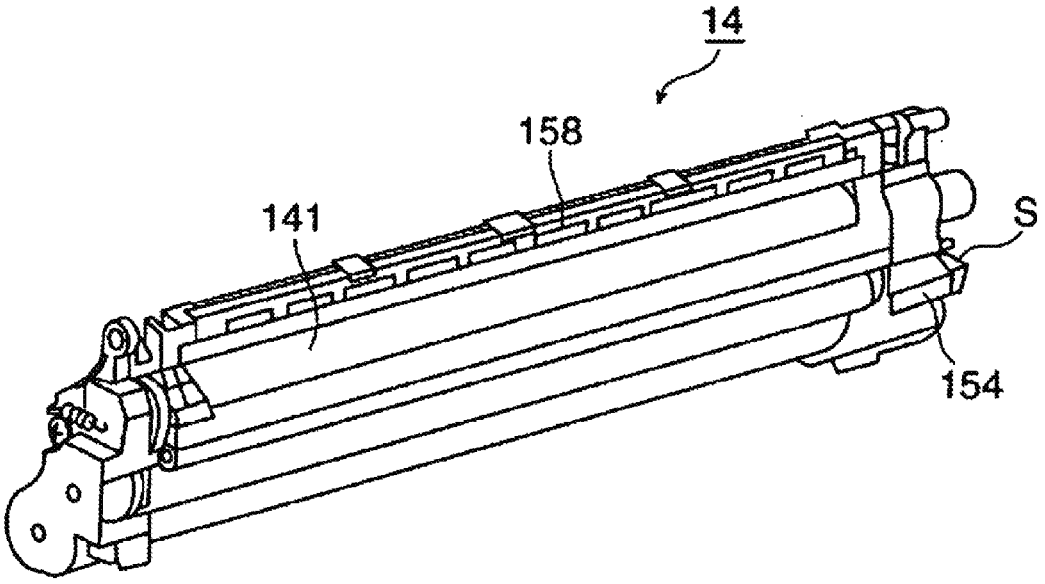
FIGS. 8A and 8B each are perspective views illustrating an external appearance of a developing device according to the first exemplary embodiment of the present invention.
Figure 8B:
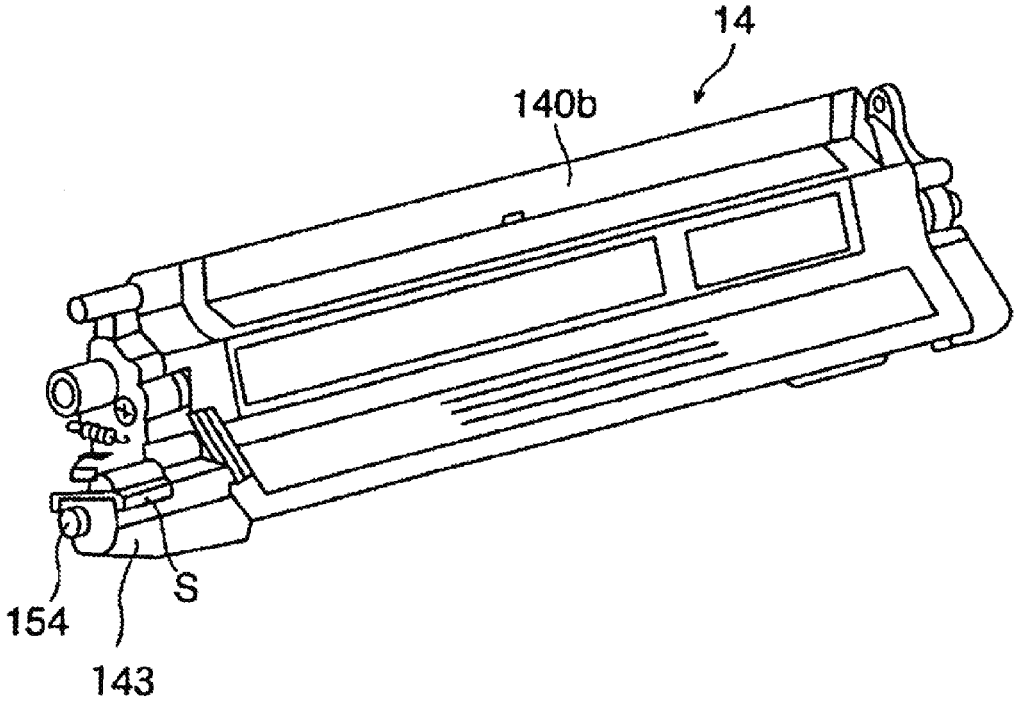

As illustrated in FIG. 7 and FIGS. 8A and 8B, the process cartridge 80 is mounted on a unit mounting portion 90 provided on the main body 1*a* of the image forming apparatus to be detachable in the axial direction of the photoconductor drum 11. In addition, in FIG. 7, reference numeral 97 indicates a positioning member that determines a position of the inner end portion in the direction in which the process cartridge 80 is mounted.

<Configuration of Developing Device>

Figure 9:
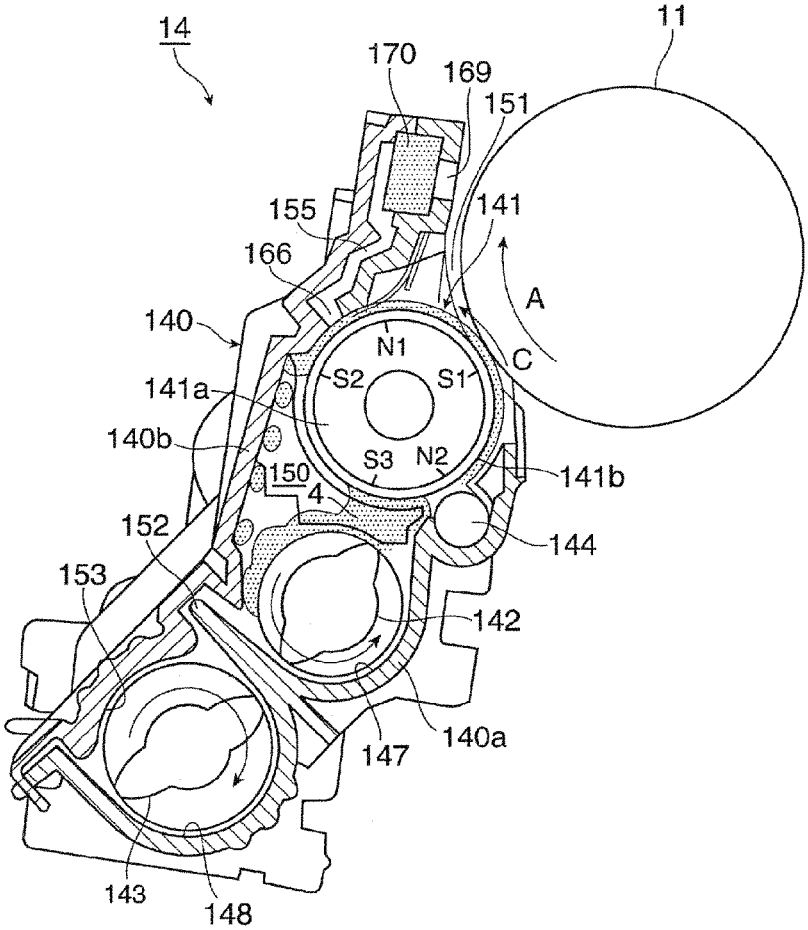
FIG. 9 is a cross-sectional configuration view illustrating the developing device according to the first exemplary embodiment of the present invention.

FIGS. 8A and 8B are a perspective configuration view at front and back sides illustrating the developing device according to the first exemplary embodiment. FIG. 9 is a cross-sectional configuration view illustrating the developing device according to the first exemplary embodiment.

As illustrated in FIGS. 8A and 8B and FIG. 9, the developing device 14 is provided with a device housing 140 which is an example of a developer accommodating container. The device housing 140 generally includes a lower housing 140*a* disposed at a lower side of the developing device 14, and an upper housing 140*b* disposed at an upper side of the developing device 14. The lower housing 140*a* and the upper housing 140*b* are hermetically bonded to each other, and as illustrated in FIG. 9, a developer accommodation chamber 150, which accommodates a two-component developer 4, is formed in the device housing 140. An opening 151 is formed in a region of the device housing 140 which faces a photoconductor drum 11. In addition, in the device housing 140, the developing roller 141 which is an example of a developer carrier is disposed to be rotatable in an arrow direction C and to be partially exposed through the opening 151. The developing roller 141 includes a magnet roller 141*a* and a cylindrical developing sleeve 141*b*. The magnet roller 141*a* is an example of a magnetic field generating member. The magnet roller 141*a* is fixedly disposed inside the developing roller 141. In the magnet roller 141*a*, magnetic poles each having a predetermined polarity are disposed at predetermined positions along a circumferential direction thereof. The developing sleeve 141*b* is an example of a developer transport member. The developing sleeve 141*b* has a cylindrical shape. The developing sleeve 141*b* is disposed on the outer circumference of the magnet roller 141*a* to be rotatable at a predetermined rotational speed along the arrow direction. The developing sleeve 141*b* is formed of a non-magnetic material such as aluminum or non-magnetic stainless steel and has a cylindrical shape.

In this exemplary embodiment, the rotation direction of the developing sleeve 141*b* is set to a direction reverse to the rotation direction of the photoconductor drum 11. That is, as illustrated in FIG. 9, while the rotation direction of the photoconductor drum 11 is set to the clockwise direction, the rotation direction of the developing sleeve 141*b* is set to the counterclockwise direction. As a result, the outer circumferential surface of the developing sleeve 141*b* is moved in the same direction as the direction in which the surface of the photoconductor drum 11 is moved, in the developing region facing the photoconductor drum 11. In addition, the rotation direction of the developing sleeve 141*b* may be set to the same direction as the rotation direction of the photoconductor drum 11.

The rotational speed of the developing sleeve 141*b* is determined depending on productivity of the image forming apparatus 1 which is determined according to the rotational speed (process speed) of the photoconductor drum 11. For example, the productivity of the image forming apparatus 1 is represented by the number of A4 size (LEF) recording sheets 5 on which the image forming apparatus 1 can form images per unit time. For example, as the productivity of the image forming apparatus 1 is increased from 30 ppm (pages/min) to 60 ppm, the rotational speed (circumferential speed) of the developing sleeve 141*b* is increased and becomes high.

The magnet roller 141*a* includes a developing magnetic pole S1, a transport magnetic pole N1, a pick-off magnetic pole S2, a pick-up magnetic pole S3, and a trimming magnetic pole N2. The developing magnetic pole S1 is disposed at a position slightly displaced from a position closest to the photoconductor drum 11 to an upstream side in the rotation direction of the photoconductor drum 11 and in a developing region facing the photoconductor drum 11. The transport magnetic pole N1 is positioned at an downstream end portion of the opening 151 of the device housing 140 in the rotation direction of the developing sleeve 141*b*. The transport magnetic pole N1 is adjacent to the developing magnetic pole S1 downstream of the developing magnetic pole S1 in the rotation direction of the developing sleeve 141*b*. The transport magnetic pole N1 transports the developer 4 used for the development to the inside of the device housing 140. The pick-off magnetic pole S2 is disposed downstream of the transport magnetic pole N1 in the rotation direction of the developing sleeve 141*b*. The pick-off magnetic pole S2 serves as a transport magnetic pole that transports the developer 4 to the inside of the device housing 140 together with the transport magnetic pole N1. The pick-off magnetic pole S2 separates the developer 4 from the surface of the developing sleeve 141*b*. The pick-up magnetic pole S3 is disposed downstream of the pick-off magnetic pole S2 in the rotation direction of the developing sleeve 141*b*. The pick-up magnetic pole S3 causes a new developer 4, which is supplied while being agitated by the supply transport member 142, to be adsorbed to the surface of the developing sleeve 141*b*. The trimming magnetic pole N2 is disposed downstream of the pick-up magnetic pole S3 in the rotation direction of the developing sleeve 141*b*. The trimming magnetic pole N2 makes a developer layer uniform together with the layer thickness regulating member 144. The layer thickness regulating member 144, which regulates the amount (layer thickness) of the developer 4 maintained on the surface of the developing sleeve 141*b*, is disposed at a position that faces the trimming magnetic pole N2 of the magnet roller 141*a*. The layer thickness regulating member 144 is formed of a magnetic material and has a columnar shape. The layer thickness regulating member 144 regulates the layer thickness of the developer 4 to a predetermined value in a state in which magnetic force of the trimming magnetic pole N2 is applied. The developer 4 transported while being adsorbed by the magnetic poles of the magnet roller 141*a* is formed as a layer in the form of a magnetic brush on the surface of the developing sleeve 141*b*.

In the device housing 140, the supply transport member 142, which is configured as a screw auger (supply auger) or the like that draws up the developer 4 accommodated in the developer accommodation chamber 150 and supplies the developer 4 to the developing roller 141, is disposed obliquely downward in the vertical direction of the developing roller 141. The supply transport member 142 is rotated counterclockwise by a driving device (not illustrated). In addition, in the device housing 140, the agitation transport member 143, which is configured as a screw auger (admix auger) that transports the developer 4 to be supplied into the device housing 140 while agitating the developer 4, is disposed obliquely downward from the supply transport member 142. The agitation transport member 143 is also rotated clockwise by the driving device (not illustrated).

In the lower housing 140*a*, a first accommodating portion 147 and a second accommodating portion 148, which have an approximately semi-cylindrical shape in cross section, are provided to accommodate the supply transport member 142 and the agitation transport member 143. The first accommodating portion 147 and the second accommodating portion 148 are divided by a partition wall 152 provided in the lower housing 140*a*. In addition, in the upper housing 140*b*, a third accommodating portion 153 is provided, which is formed to define a part of a substantially cylindrical cross section that forms a transport path of the developer 4 together with the second accommodating portion 148 of the lower housing 140*a*.

First and second path portions (not illustrated), where the developer 4 is delivered between the supply transport member 142 and the agitation transport member 143, are formed at both end portions, respectively, in a longitudinal direction of the partition wall 152. In addition, as illustrated in FIG. 8B, the inner end portion in the axial direction of the agitation transport member 143 extends to protrude to the rear side of the device housing 140. A supply unit 154 having a substantially cylindrical shape is provided on the extension portion of the agitation transport member 143. In addition, a supply port (not illustrated), through which the developers 4, each of which has a corresponding color, are provided from, the toner cartridges 145Y, 145M, 145C, and 145K, is opened in the supply unit 154 having the cylindrical shape. In addition, the supply port is covered by a shutter member S to be capable of being opened/closed.

Recently, in the developing device 14 configured as described above, a rotational speed of the developing roller 141 or the like tends to is increased so as to enable the improvement of productivity required for the image forming apparatus 1. In a case in which the rotational speed of the developing roller 141 becomes high in the developing device 14, the amount of air, which is introduced into the device housing 140 from the opening 151 in accordance with the rotation of the developing roller 141, tends to be increased, and the internal pressure of the device housing 140 tends to be increased.

Figure 10:
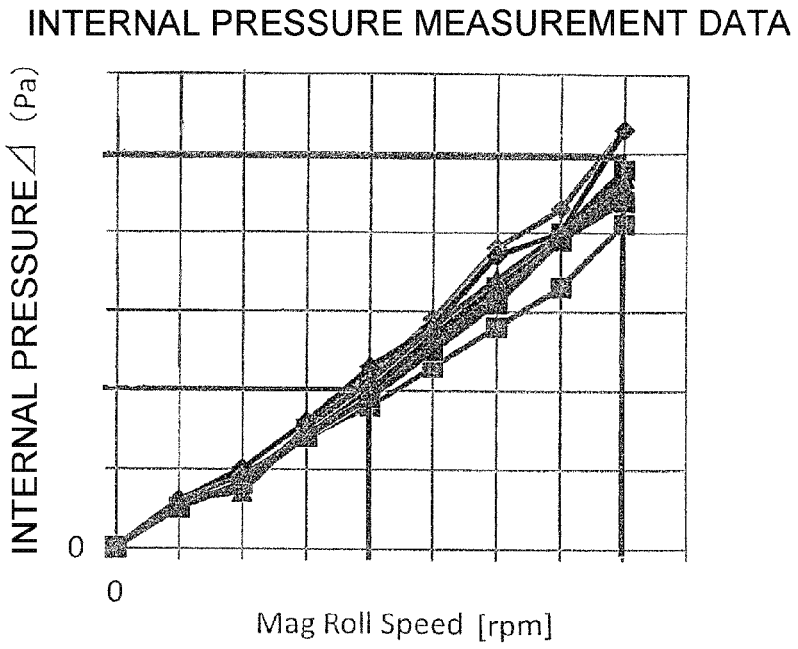
FIG. 10 is a graph illustrating a relationship between a rotational speed of a developing roller and an internal pressure of a device housing.

FIG. 10 is a graph illustrating a result obtained by measuring a degree to which the internal pressure of the device housing 140 increases by continuously operating the developing device 14 in a case in which the rotational speed of the developing roller 141 is increased to 60 ppm according to the improvement of productivity of the image forming apparatus 1. In addition, the internal pressure of the device housing 140 is measured plural times by variously changing the position in the device housing 140.

As is apparent from FIG. 10, in a case in which the productivity of the image forming apparatus 1 is improved twice from 30 ppm to 60 ppm, the internal pressure of the device housing 140 tends to be greatly increased as the rotational speed of the developing roller 141 is increased. In particular, it has been found that when the productivity of the image forming apparatus 1 is set to 60 ppm, the internal pressure of the device housing 140 is rapidly increased to about 50 Pa with continuous driving according to the increase of the rotational speed of the developing roller 141.

Figure 11:
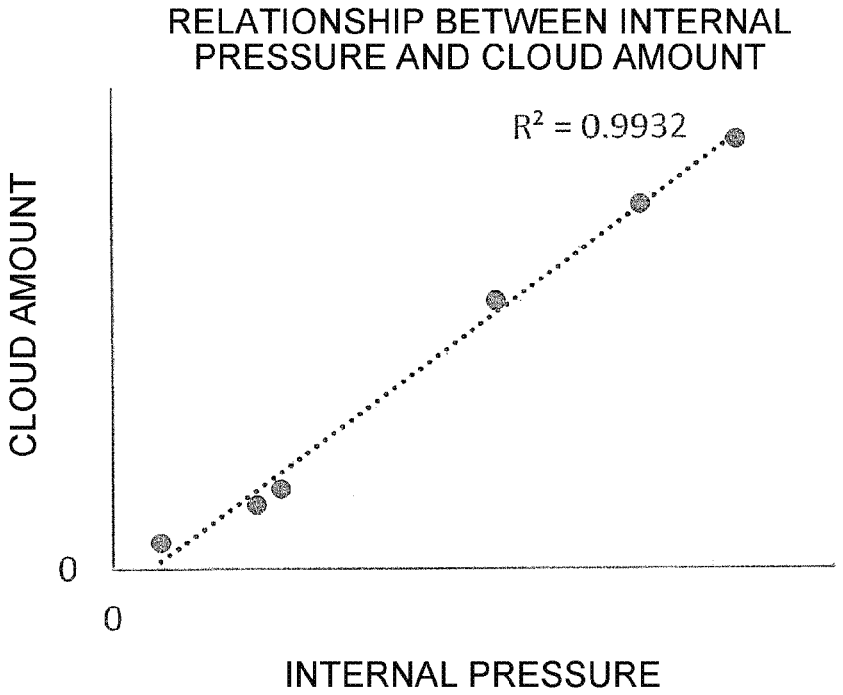
FIG. 11 is a graph illustrating a relationship between the internal pressure of the device housing and the amount of occurring toner cloud.

When the internal pressure of the device housing 140 is increased, toner scattering so-called toner cloud may be caused from a region that faces the opening 151 of the developing roller 141. As illustrated in FIG. 11, it has been found, by researches conducted by the present inventors, that the amount of occurring toner cloud is approximately proportional to the internal pressure of the device housing 140.

Therefore, in this exemplary embodiment, as illustrated in FIG. 9, in order to inhibit the occurrence of the toner cloud which is caused according to the increase of the rotational speed of the developing roller 141, the device housing 140 is configured to inhibit the internal pressure thereof by forming an exhaust path 155 in the device housing 140, and exhausting the air within the device housing 140 to the outside from the exhaust path 155.

Figure 12:
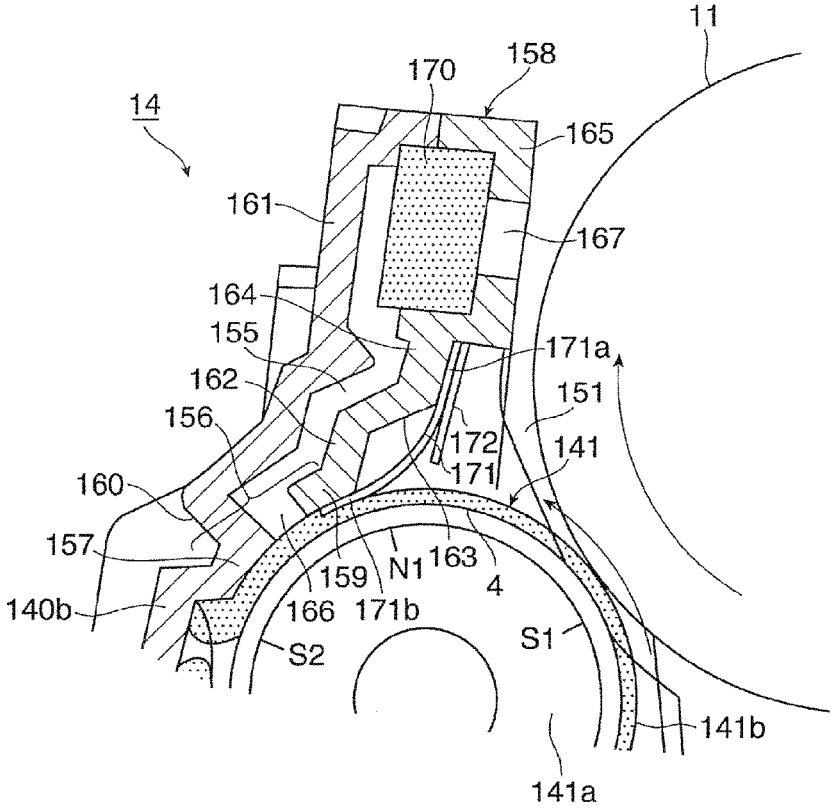
FIG. 12 is an enlarged cross-sectional configuration view illustrating a main part of the developing device according to the first exemplary embodiment of the present invention.

As illustrated in FIGS. 9 and 12, the device housing 140 of the developing device 14 has a downstream side covering portion 156 that covers an outer circumferential surface of the developing roller 141 exposed to the outside at the downstream side of the opening 151 in the rotation direction of the developing roller 141. The downstream side covering portion 156 of the device housing 140 includes a partial cylindrical portion 157 of the device housing 140 which is disposed to cover the outer circumferential surface of the developing roller 141 with a predetermined gap therebetween along the outer circumferential surface of the developing roller 141, and a portion 159 of a exhaust path forming member 158 that constitutes a developer accommodating container mounted on the inner surface of the device housing 140.

The upper housing 140*b* of the device housing 140 has a cylindrical portion 157 formed in a snort cylindrical shape to cover the outer circumferential surface of the developing roller 141 with a predetermined gap therebetween at a position adjacent to the upstream side in the rotation direction of the developing roller 141 on the outer circumference of the pick-off magnetic pole S2 of the magnet roller 141*a*. The upper housing 140*b* is provided with an extension portion 161 disposed to extend toward the downstream side in the rotation direction of the photoconductor drum 11 through an upstanding portion 160 that slightly upstands outward in a radial direction of the developing roller 141 at the upstream side of the cylindrical portion 157 in the rotation direction of the developing roller 141. As illustrated in FIG. 8A, the exhaust path forming member 158 is mounted in the extension portion 161 of the upper housing 140*b* via snap-fit engaging portions (not illustrated) at plural positions in the longitudinal direction.

The exhaust path forming member 158 has the cylindrical portion 159 disposed at the downstream side end portion of the exhaust path forming member 158 in the rotation direction of the developing roller 141 to face the cylindrical portion 157 of the upper housing 140*b* through a suction port of the exhaust path. The cylindrical portion 159 is formed in a short cylindrical shape to cover the outer circumferential surface of the developing roller 141 with a predetermined gap therebetween. In addition, the exhaust path forming member 158 includes a first inclined portion 162, a second inclined portion 163, and a filter accommodating portion 165, upstream of the cylindrical portion 159 in the rotation direction of the developing roller 141. The first inclined portion 162 is obliquely inclined in a separating direction from the outer circumferential surface of the developing roller 141. The second inclined portion 163 is obliquely inclined in an approaching direction to the photoconductor drum 11. The filter accommodating portion 165 is provided a tip end of the second inclined portion 163 via a flat plate portion 164 formed in a short flat plate shape. The filter accommodating portion 165 is formed with a recess portion. The recess portion accommodates a filter which captures the developer included in the exhausted air passing through the exhaust path 155. The filter is an example of a capturing member.

A suction port 166 of the exhaust path 155 is opened to face the surface of the developing roller 141 between the cylindrical portion 157 of the upper housing 140*b* and the cylindrical portion 159 of the exhaust path forming member 158. The suction port 166 of the exhaust path 155 is positioned at a midway between the transport magnetic pole N1 and the pick-off magnetic pole S2 of the magnet roller 141*a*. At the midway point between the transport magnetic pole N1 and the pick-off magnetic pole S2 of the magnet roller 141*a*, the magnetic brush of the developer 4 maintained on the outer circumference of the developing sleeve 141*b* is lying approximately in parallel on the surface of the developing sleeve 141*b* along a magnetic force line formed between the transport magnetic pole N1 and the pick-off magnetic pole S2. In addition, the suction port 166 of the exhaust path 155 is opened at a position where the surface of the upper housing 140*b* and the surface of the developing sleeve 141*b* face each other with a minute gap therebetween. For this reason, the developer 4 is prevented from leaking out from the suction port 166 when the process cartridge 80 is transported. In addition, in the filter accommodating portion 165 of the exhaust path forming member 158, an exhaust port 167 is opened to face the outer circumferential surface of the photoconductor drum 11.

The exhaust path forming member 158 is mounted on the upper housing 140*b* such that the exhaust path 155 is formed between the outer surface of the exhaust path forming member 158 and the inner surface of the upper housing 140*b*. The exhaust path 155 is formed over an approximately overall length of the developing roller 141 in the axial direction of the developing roller 141. A path in an intermediate portion of the exhaust path 155, which is directed toward the exhaust port 169 from the suction port 166, is formed in a bending shape. The exhaust path 155 is configured as follows. That is, when the air is exhausted from the interior of the device housing 140 along the bending inner surface, the toner of the developer 4 included in the exhausted air collides with the bending inner surface, such that a part of the toner is attached and removed.

A filter 170 which is an example of a capturing member is accommodated in the filter accommodating portion 165 of the exhaust path forming member 158. The filter 170 is formed in a thin and elongated rectangular parallelepiped shape having a rectangle shape in cross section according to the shape of the filter accommodating portion 165. A filter made of polytetrafluoroethylene (PTFE) and the like in the form of a non-woven fabric or fibers is used as the filter 170. However, the filter 170 may be formed of a non-woven fabric in consideration of a pressure reduction effect over time in the device housing 140 and a toner cloud inhibiting effect.

Figure 13:
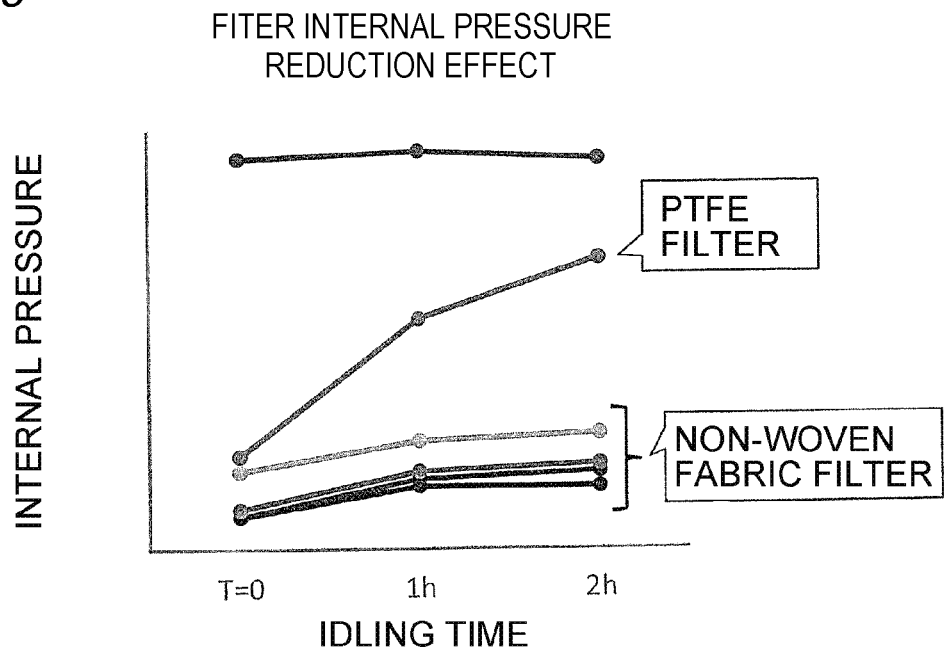
FIG. 13 is a graph illustrating a relationship between a material of a filter and an internal pressure of the device housing.

FIG. 13 is a graph illustrating a result obtained by confirming pressure reduction effects of the non-woven fabric and the polytetrafluoroethylene (PTFE) over time in the device housing 140.

As illustrated in FIG. 12, the device housing 140 is provided with a seal member 171. The seal member 171 is an example of a closing member. The seal member 171 is sandwiched between the device housing 140 and the developer 4 carried on the developing roller 141 to close a gap formed between the device housing 140 and the developer 4 held on the developing roller 141. A film or sheet made of synthetic resin having flexibility and being elastically deformable, such as polyurethane or polyolefine, may be used as the seal member 171. A base end portion 171*a* of the seal member 171 is attached to the outer surface of a flat plate portion 164 of the exhaust path forming member 158 by a double-sided tape, an adhesive, or the like. In addition, a tip portion 171*b* of the seal member 171 is sandwiched between the device housing 140 and the developer 4 held on the developing roller 141. In more detail, the tip portion 171*b* of the seal member 171 is sandwiched between the cylindrical portion 159 of the exhaust path forming member 158 and the developer 4 held on the developing roller 141. In consideration of the seal effect of the seal member 171, the seal member 171 may be set to have a length that is reliably sandwiched by the device housing 140 and the developer 4 held on the developing roller 141. In this case, the tip portion 171*b* of the seal member 171 may extend to a position close to the upstream side of the suction port 166 of the exhaust path 155 in the rotation direction of the developing roller 141.

Figure 14:
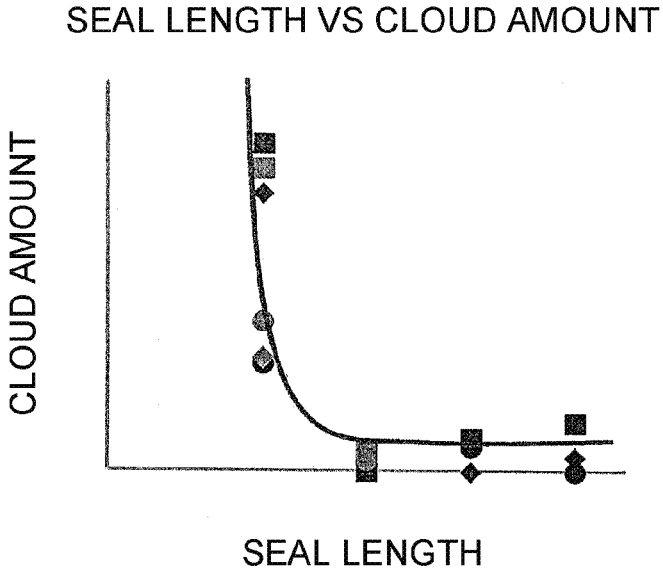
FIG. 14 is a graph illustrating a relationship between a length of a seal member and an effect of inhibiting toner cloud.

FIG. 14 is a graph illustrating a relationship between the length of the seal member 171 and the amount of occurring toner cloud.

As is apparent from FIG. 14, it can be seen that the seal effect of the seal member 171 at the opening 151 of the device housing 140 is obtained when the length of the seal member 171 is set to be long. It can be seen that, when the length of the seal member 171 is set to be long, the toner cloud inhibiting effect is improved.

To a surface of the seal member 171, a support member 172 is attached by a double-sided tape, an adhesive, or the like to support the seal member 171. The support member 172 is formed as a plate shaped member made of a hard synthetic resin material. The length of the support member 172 is set to be shorter than that of the seal member 171. The support member 172 supports the surface of the seal member 171, thereby preventing the developer from leaking out from the accommodating container, for example, during physical distribution.

<Operation of Characteristic Part of Developing Device>

As illustrated in FIG. 9, in the developing device 14 according to the first exemplary embodiment, when an electrostatic latent image formed on the surface of the photoconductor drum 11 is developed, the developing roller 141 is rotated clockwise by a driving device (not illustrated) at a speed corresponding to a process speed which is the rotational speed (circumferential speed) of the photoconductor drum 11. In addition, in the developing device 14, the supply transport member 142 and the agitation transport member 143 are rotated by a driving device (not illustrated) at a speed corresponding to the rotational speed of the developing roller 141.

As illustrated in FIG. 10, in the developing device 14, as the rotational speed of the developing roller 141 is increased, the amount of air introduced into the device housing 140 and the internal pressure of the device housing 140 are increased according to the rotation of the developing sleeve 141*b*.

In that event, as illustrated in FIG. 12, the exhaust path 155 is formed in the device housing 140 to exhaust the air in the device housing 140 to the outside. The suction port 166 of the exhaust path 155 is opened between the transport magnetic pole N1 and the pick-off magnetic pole S2 of the magnet roller 141*a* at the outer circumference of the developing roller 141. For this reason, the air in the device housing 140 is introduced into the exhaust path 155 from the suction port 166, passes through the interior of the exhaust path 155, and then is discharged to the outside through the filter 170 from the exhaust port 167. As a result, in the developing device 14, the increase of the internal pressure of the device housing 140 is inhibited, and the occurrence of the toner cloud caused by the increase of the internal pressure of the device housing 140 is inhibited. In addition, because the filter 170 is disposed in the outlet portion of the exhaust path 155, the toner in the air exhausted to the outside via the exhaust path 155 is captured and removed by the filter 170. In addition, because the exhaust path 155 is formed in a bending shape rather than a straight shape, a part of the toner in the air passing through the exhaust path 155 collides with the inner wall of the exhaust path 155, and thus is removed by being attached to the inner wall of the exhaust path 155.

As illustrated in FIG. 12, the exhaust port 167 of the exhaust path 155 is opened at a position that faces the outer circumferential surface of the photoconductor drum 11. Thus, even if a small amount of toner is present in the air exhausted to the outside from the exhaust port 167, the toner is captured by colliding with the outer circumferential surface of the photoconductor drum 11 so that the toner is prevented from being discharged to the outside of the main body 1*a* of the image forming apparatus from the developing device 14.

In this exemplary embodiment, the seal member 171 is provided in the region facing the opening 151 of the device housing 140. The base end portion 171*a* of the seal member 171 is fixed to the device housing 140. The tip portion 171*b* of the seal member 171 is sandwiched between the device housing 140 and the developer 4 carried on the developing roller 141, downstream of the opening 151 in the rotation direction of the developing roller 141. The seal member 171 closes a gap. For this reason, the occurrence of the toner cloud, which leaks out to the outside from the opening 151 positioned downstream of the device housing 140 in the rotation direction of the developing roller 141, is inhibited by the seal member 171. In addition, the seal member 171 also serves to inhibit air from being introduced into the device housing 140 according to the rotation of the developing roller 141.

Experimental Example

Next, as illustrated in FIGS. 9 and 12, the present inventors experimentally manufacture a developing device 14 and performed an experiment for checking how much toner cloud occurs as the internal pressure of the device housing 140 of the developing device 14 is increased when the developing device 14 is continuously driven. In addition, the rotational speed of the developing sleeve 141*b* is set to a speed at which the productivity of the image forming apparatus 1 corresponds to 60 ppm. In addition, as a comparative example, the inventors experimentally manufactures a developing device 14 in which the rotational speed of the developing sleeve 141*b* is set to a speed at which the productivity of the image forming apparatus 1 corresponds to 30 ppm, and performed an experiment for checking how much toner cloud occurs when the developing device 14 is continuously driven. In addition, the developing device 14 in which the productivity is set to 30 ppm and neither exhaust path nor seal member is provided is used as Comparative Example 1, the developing device 14 in which the productivity is set to 60 ppm and neither exhaust path 155 nor seal member 171 is provided is used as Comparative Example 2, the developing device 14 in which the productivity is set to 60 ppm and only the seal member 171 is provided is used as Comparative Example 3, and the developing device 14 in which the productivity is set to 60 ppm and only the exhaust path 155 to which a filter member is attached is provided is used as Comparative Example 4.

Figure 15:
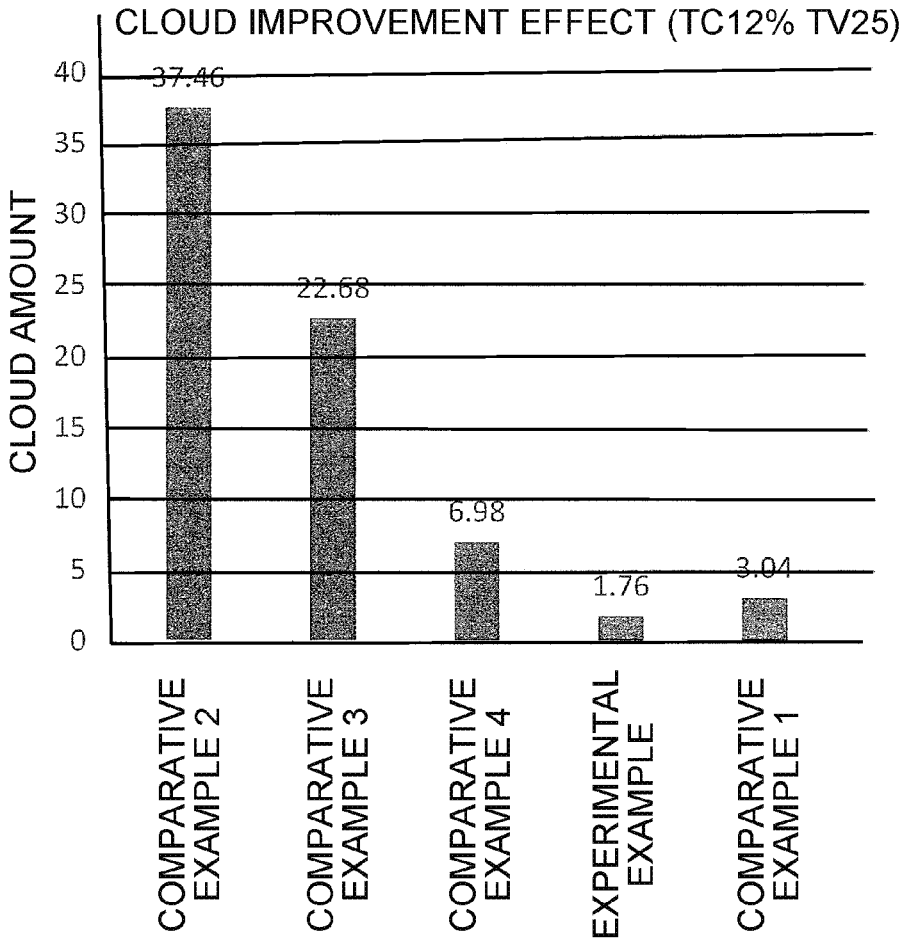
FIG. 15 is a graph illustrating results of an experimental example and comparative examples.

FIG. 15 is a graph illustrating results of the experimental examples.

As is apparent from the graph in FIG. 15, it has been found that even in case in which the rotational speed of the developing sleeve 141*b* is increased to a speed at which the productivity of the image forming apparatus 1 corresponds to 60 ppm, the developing device 14 according to the present exemplary embodiment may reduce the amount of toner cloud occurring from the device housing 140, compared to the developing device 14 of Comparative Example 1 in which neither exhaust path 155 nor seal member 171 is provided and the productivity is set to 30 ppm.

In the case of the developing device of Comparative Example 3 in which only the seal member 171 is provided and the productivity is set to 60 ppm, the amount of occurring toner cloud is decreased compared to the developing device of Comparative Example 2 in which neither exhaust path 155 nor seal member 171 is provided and the productivity is set to 60 ppm. However, the effect of inhibiting the occurrence of toner cloud is insufficient, as well.

In the case of the developing device 14 of the Comparative Example 4 in which only the exhaust path 155 to which a filter is attached is provided and the productivity is set to 60 ppm, the amount of occurring toner cloud is decreased compared to the developing device 14 of Comparative Example 3 in which the seal member 171 is provided and the productivity is set to 60 ppm. However, the effect of inhibiting the occurrence of toner cloud is insufficient, as well.

In addition, the exemplary embodiment has been described with reference to a case of being applied to the full-color image forming apparatus. However, the exemplary embodiment may be equally applied to a monochrome image forming apparatus.

The exemplary embodiment has been described with reference to a case in which a developing unit attachable to/detachable from the image forming apparatus is configured as the developing device. However, the developing device may be fixedly disposed in the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer accommodating container configured to accommodate a developer;

a developer carrier disposed in an opening of the developer accommodating container to be rotated while facing an image carrier, and configured to carry the developer;

an exhaust path configured to exhaust an air in the developer accommodating container to an outside;

a capturing member configured to capture a toner in the exhausted air passing through the exhaust path; and a closing member including:

a base end portion held by the developer accommodating container; and a tip end portion sandwiched between the developer accommodating container and the developer carried on the developer carrier, downstream of the opening in a rotation direction of the developer carrier, wherein the closing member is configured to close a gap, wherein the exhaust path is configured to be formed with a suction port, wherein the suction port is configured to be opened in a downstream covering region where the developer accommodating container covers an outer circumferential surface of the developer carrier downstream of the opening in the rotation direction of the developer carrier, and wherein the exhaust path includes an exhaust port that is opened at a position that faces an outer circumferential surface of the image carrier.

2. A developing device comprising:

a developer accommodating container configured to accommodate a developer;

a developer carrier disposed in an opening of the developer accommodating container to be rotated while facing an image carrier, and configured to carry the developer;

an exhaust path configured to exhaust an air in the developer accommodating container to an outside;

a capturing member configured to capture a toner in the exhausted air passing through the exhaust path; and a closing member including:

a base end portion held by the developer accommodating container; and a tip end portion sandwiched between the developer accommodating container and the developer carried on the developer carrier, downstream of the opening in a rotation direction of the developer carrier, wherein the closing member is configured to close a gap, wherein the exhaust path includes a suction port that is opened at a position where the developer carrier is closest to the developer accommodating container, and wherein the exhaust path includes an exhaust port that is configured to be opened at a position that faces an outer circumferential surface of the image carrier.

3. The developing device according to claim 1, wherein the exhaust path is formed by the developer accommodating container and an exhaust path forming member provided inside the developer accommodating container.

4. The developing device according to claim 2, wherein the exhaust path includes an exhaust port that is opened at a position that faces an outer circumferential surface of the image carrier.

5. The developing device according to claim 1, comprising:

an exhaust path forming member configured to form an exhaust path, wherein the exhaust path forming member serves as a holding member configured to hold the capturing member.

6. The developing device according to claim 2, comprising:

an exhaust path forming member configured to form an exhaust path, wherein the exhaust path forming member serves as a holding member configured to hold the capturing member.

7. The developing device according to claim 1, wherein the developer carrier includes:

a developer transport member having a cylindrical shape; and a magnetic field generating member that is fixedly disposed in the developer transport member and that has a plurality of magnetic poles, wherein the suction port of the exhaust path is opened between a transport magnetic pole of the magnetic field generating member and a separation magnetic pole of the magnetic field generating member, on an outer circumference of the developer carrier, wherein the transport magnetic pole transports the developer passing through a region facing the image carrier to the developer accommodating container, and wherein the separation magnetic pole separates the developer from an outer circumferential surface of the developer carrier.

8. The developing device according to claim 2, wherein the developer carrier includes:

a developer transport member having a cylindrical shape; and a magnetic field generating member that is fixedly disposed in the developer transport member and that has a plurality of magnetic poles, wherein the suction port of the exhaust path is opened between a transport magnetic pole of the magnetic field generating member and a separation magnetic pole of the magnetic field generating member, on an outer circumference of the developer carrier, wherein the transport magnetic pole transports the developer passing through a region facing the image carrier to the developer accommodating container, and wherein the separation magnetic pole separates the developer from the outer circumferential surface of the developer carrier.

9. The developing device according to claim 1, wherein the closing member is formed of a flexible synthetic resin sheet.

10. The developing device according to claim 2, wherein the closing member is formed of a flexible synthetic resin sheet.

11. An image forming apparatus comprising:

a developing device according to claim 1, wherein the image carrier is configured to carry an electrostatic latent image, and wherein the developing device is configured to develop the electrostatic latent image carried on the image carrier.

* * * * *